US008661962B1

(12) United States Patent
Hart et al.

(10) Patent No.: US 8,661,962 B1
(45) Date of Patent: Mar. 4, 2014

(54) BIPOD-MOUNTED MORTAR FIRE CONTROL SYSTEM

(75) Inventors: Jeffery Hart, Landing, NJ (US); Scott Montanio, Wharton, NJ (US); Benjamin Lewin, Great Meadows, NJ (US); Steven McDonald, Bangor, PA (US); Raul Galliano, Secaucus, NJ (US); John N. Gravina, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 250 days.

(21) Appl. No.: 13/197,978

(22) Filed: Aug. 4, 2011

(51) Int. Cl.
*F41F 1/06* (2006.01)

(52) U.S. Cl.
USPC ..... 89/37.05; 89/41.01; 89/41.02; 235/404; 235/407; 235/414

(58) Field of Classification Search
USPC ..... 89/37.05, 41.01, 41.02; 235/404, 407, 235/414
See application file for complete search history.

(56) References Cited

U.S. PATENT DOCUMENTS 3,782,243 A * 1/1974 Ziegler ..... 89/37.05
2010/0269681 A1* 10/2010 Shipman et al. ..... 89/42.01

* cited by examiner

*Primary Examiner* — J. Woodrow Eldred
(74) *Attorney, Agent, or Firm* — Michael C. Sachs

(57) ABSTRACT

An apparatus for mounting an electronics unit, such as a digital pointing device, to a mortar bipod may include a pair of spaced-apart, generally parallel mounting brackets having respective inner faces. A pair of support rails may be fixed to opposite outer edges of the mounting brackets. A pair of support rods may be fixed between opposite lower portions of the mounting brackets. A lower guide rod housing may be fixed to first ends of the support rails. A pair of fire control guide rods may have first ends fixed to the lower guide rod housing. A plurality of shock mounts may have respective bases and tops. The shock mount bases may be fixed to the respective inner faces of the mounting brackets. The electronics unit may include a top plate fixed thereto. A pair of side plates may be fixed to the top plate. The side plates may extend generally perpendicularly from the top plate. The tops of the shock mounts may be fixed to the side plates.

12 Claims, 7 Drawing Sheets

BIPOD-MOUNTED MORTAR FIRE CONTROL SYSTEM

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar systems and in particular to the mounting of digital fire control systems for mortar systems.

During firing of a mortar system, a mortar round is dropped into the top of a cannon and slides down until it hits a firing pin at the bottom. Impact with the firing pin ignites the propellant behind the projectile, creating tremendous pressures and ejecting the projectile out of the cannon. The large pressure forces react against the pressure vessel or cannon and translate into the baseplate, thereby forcing both the cannon and baseplate to move into the ground surface. This movement or burying effect into the ground is typical of all dismounted mortar systems.

During the above firing procedure, the bipod is responsible for supporting and stabilizing the cannon. This is done mostly with the buffer system. The buffer system uses springs to isolate or disconnect the firing forces away from the bipod itself. The buffer system allows the cannon and baseplate to move into the ground while maintaining stabilization of the bipod.

Digital fire control systems (DFCS) (for example, Honeywell's TALIN 3000 digital pointing device) may be used with some mortar systems, for example, 120 mm mortar systems. The extreme accelerations experienced by a mortar system during firing may damage sensitive DFCS components. In known mortar systems, the DFCS is mounted on the cannon, whether or not there is a mechanism for isolating the DFCS from large accelerations. In addition, when the DFCS is mounted directly to the cannon, it may be removed from the cannon in the event of a misfire or for hand transportation. The specific torque requirements for direct mounting may prevent the DFCS from being easily removed from the cannon.

Large mortar systems, such as a 120 mm mortar system, may be integrated into a tracked mortar carrier, such as the M1064 mortar carrier. Or, they may be integrated into a trailer or vehicle mount, such as the M326 Quick Stow trailer mount, and subsequently used in a dismounted fashion. The known DFCS mounts for the tracked mortar carrier and the trailer mount each have a different design and require different specifications for actual mounting to the cannon. Both DFCS mounts are attached directly to the cannon. The M326 Quick Stow DFCS mounting system includes an integrated isolation system (separate from the bipod isolation system) that is required to meet survivability criteria for dismounted or ground-mounted 120 mm mortar firing. On the other hand, the M1064 tracked mortar carrier DFCS mount does not require an additional isolation system.

The known mounting methods for mortar DFCS may be satisfactory for their individual platform. However, there is no single mounting method that may be used with both the M1064 and M326 platforms. In addition, neither method allows one to easily remove the fire control mounting hardware from the cannon after a misfire. Because both known mounting methods interface directly with cannon, those methods have precise torque requirements that if not adhered to, can disrupt the functionality of the cannon. Because the harshest firing environment is in the dismounted configuration, the M326 Quick Stow DFCS mount has a very large size and weight. The large size and weight of the mount are needed to meet the shock requirements for DFCS, but are otherwise very undesirable.

A need exists for an apparatus for mounting an electronics unit to a portion of a bipod that is not fixed for movement with a cannon.

SUMMARY OF THE INVENTION

It is an object of the invention to provide an apparatus for mounting an electronics unit to a portion of a bipod that is not fixed for movement with a cannon.

One aspect of the invention is an apparatus for mounting an electronics unit to a mortar bipod. The apparatus may include a pair of spaced-apart, generally parallel mounting brackets having respective inner faces. A pair of support rails may be fixed to opposite outer edges of the mounting brackets. A pair of support rods may be fixed between opposite lower portions of the mounting brackets. A lower guide rod housing may be fixed to first ends of the support rails. A pair of fire control guide rods may have first ends fixed to the lower guide rod housing.

The apparatus may include a plurality of shock mounts having respective bases and tops. The shock mount bases may be fixed to the respective inner faces of the mounting brackets. The electronics unit may have a top plate fixed thereto. A pair of side plates may be fixed to the top plate and may extend generally perpendicular thereto. The tops of the shock mounts may be fixed to the side plates. Bearings may be disposed on each of the fire control guide rods.

A traverse yoke may be fixed to seconds ends of the pair of support rails. The traverse yoke may include a pair of openings for receiving the pair of fire control guide rods. Removable fasteners may be included for fixing the second ends of the support rails to the traverse yoke and for fixing the first ends of the support rails to the lower guide rod housing.

Another aspect of the invention is a mortar bipod. The mortar bipod may include a pair of leg assemblies and a cross-level mechanism connected to one of the leg assemblies. An elevation assembly may be connected to the cross-level mechanism and to a traverse assembly. The afore-described apparatus for mounting an electronics unit to a mortar bipod may be included with the mortar bipod. The traverse assembly may include the traverse yoke.

The mortar bipod may include a cannon lower clamp and a pair of bipod buffers. Each bipod buffer may include a recoil housing fixed to the cannon lower clamp for translation therewith. The traverse yoke may include a second pair of openings for receiving ends of the bipod buffers. The ends of the bipod buffers may be fixed to the traverse yoke.

The pair of fire control guide rods may be translatably disposed in openings in the cannon lower clamp. Each bipod buffer may include a recoil spring housing translatably disposed in the recoil housing, a recoil rod guide fixed for translation with the recoil housing, and at least one spring disposed in the recoil spring housing. The at least one spring may be compressed by translation of the recoil rod guide.

A further aspect of the invention is a mortar system. The mortar system may include the afore-described mortar bipod and a cannon upper clamp. A cannon may be fixed between the cannon upper clamp and the cannon lower clamp. A baseplate may receive an end of the cannon.

A method of isolating an electronics unit from firing loads of a cannon may include providing a bipod for the cannon and mounting the electronics unit on a portion of the bipod that is not fixed for movement with the cannon.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A mortar bipod may include an apparatus for mounting mortar fire control hardware or other electronics which are required to be co-oriented with the mortar cannon tube. The bipod may be axially buffered from the cannon tube and its associated recoil shock. Compared to mounting the electronics to a buffered assembly that is attached directly to the cannon tube, mounting the electronics to a buffered bipod may eliminate the need to remove the electronics from the cannon tube when the cannon tube is removed, such as in misfire procedures. In prior art mortar systems, the fire control hardware, such as a pointing device or DFCS, may be mounted to the cannon tube.

The novel mortar bipod may better isolate the DFCS from the harsh firing environment and may minimize the shock loads experienced by the DFCS. The novel mortar bipod may also weigh much less than prior art bipods. For example, an embodiment of the novel mortar bipod for use with a 120 mm mortar system may weigh about 38% less than the known 120 mm bipod. The novel mortar bipod may not require the cannon mounting bracket used with prior bipods.

The novel bipod may interface with both the M1064 Mortar Carrier mounted configuration and the M326 Quick Stow dismounted configuration. Because the DFCS may be integrated within the bipod, it may utilize the de-coupling technique that many bipods possess. The decoupling technique may minimize the firing accelerations to which the DFCS may be exposed. The novel bipod may avoid interference with misfire procedures because it is not mounted directly to the cannon. Therefore, the bipod may be easily separated from the cannon.

A DFCS is highly sensitive electronic equipment that cannot withstand the shock loads created during a typical mortar firing. In known mortar systems, the DFCS is mounted on the cannon, in one way or another. Although one of these known mounting methods has a separate isolation system, mounting the DFCS on the cannon is not conducive to protecting its sensitive electronic equipment. The novel mortar bipod may utilize a typical bipod disconnect feature by mounting the DFCS to the side of the bipod that is disconnected or isolated from the firing loads.

Figure 1:
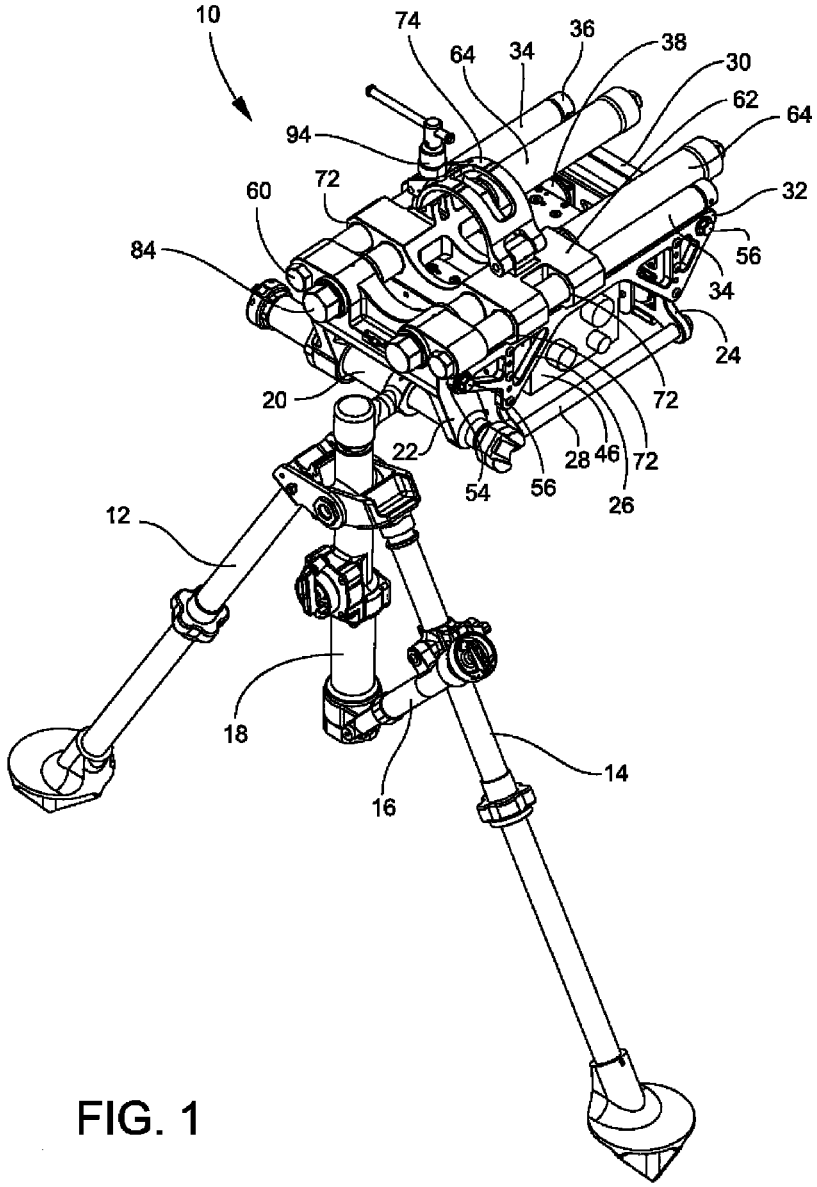
FIG. 1 is a perspective view of an embodiment of a mortar bipod with a DFCS.
Figure 3:
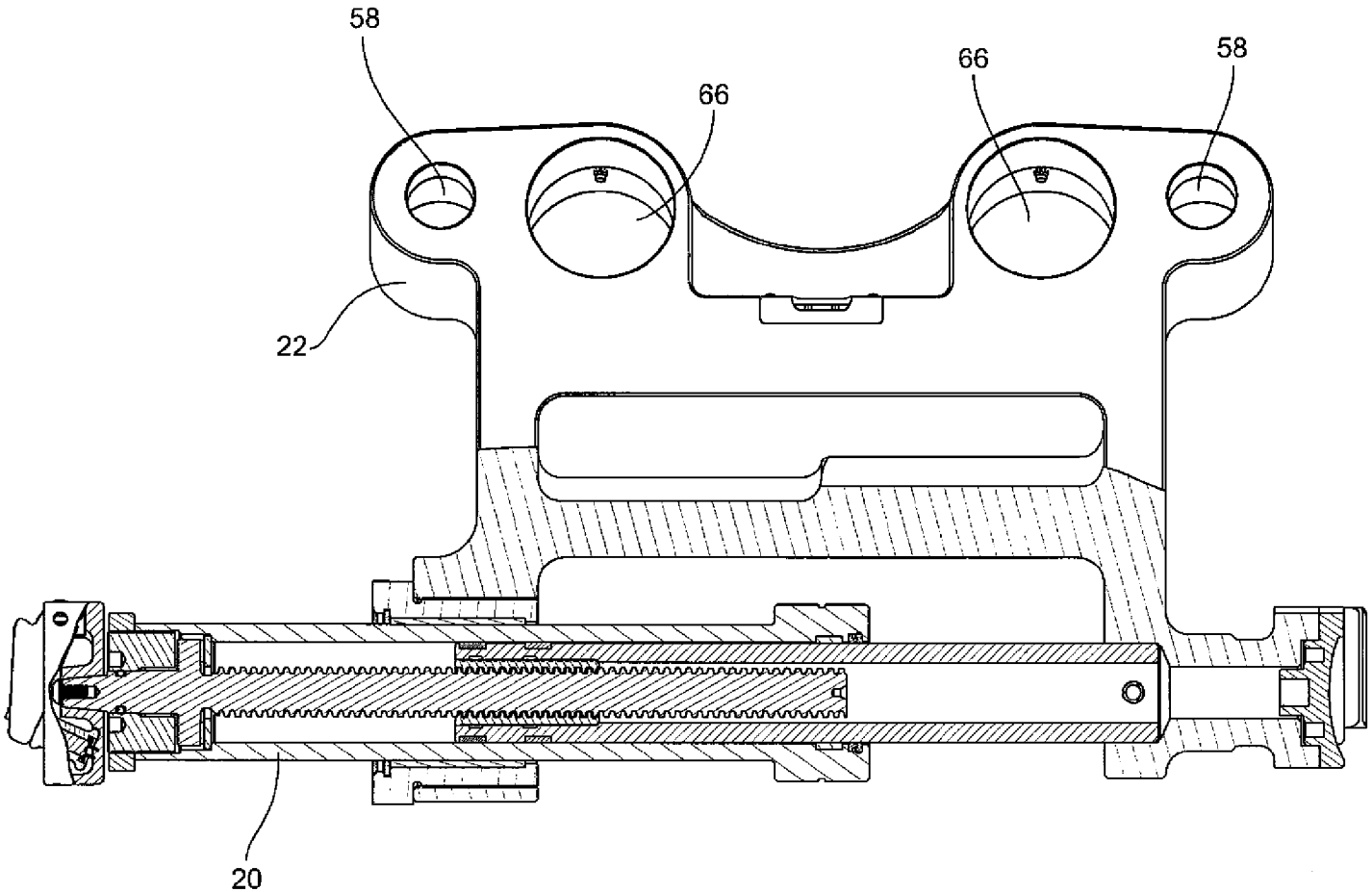
FIG. 3 is a sectional view of the yoke and traverse assembly of the mortar bipod of FIG. 1.

FIG. 1 is a perspective view of an embodiment of a mortar bipod 10 with an electronics unit, for example, a DFCS 46. Bipod 10 may include left and right leg assemblies 12, 14. A cross-level mechanism 16 may be connected to one of the leg assemblies, such as leg assembly 14. An elevation assembly 18 may be connected to cross-level mechanism 16 and to a traverse assembly 20. Traverse assembly 20 may include a traverse yoke 22 (also shown in FIG. 3)

Figure 2:
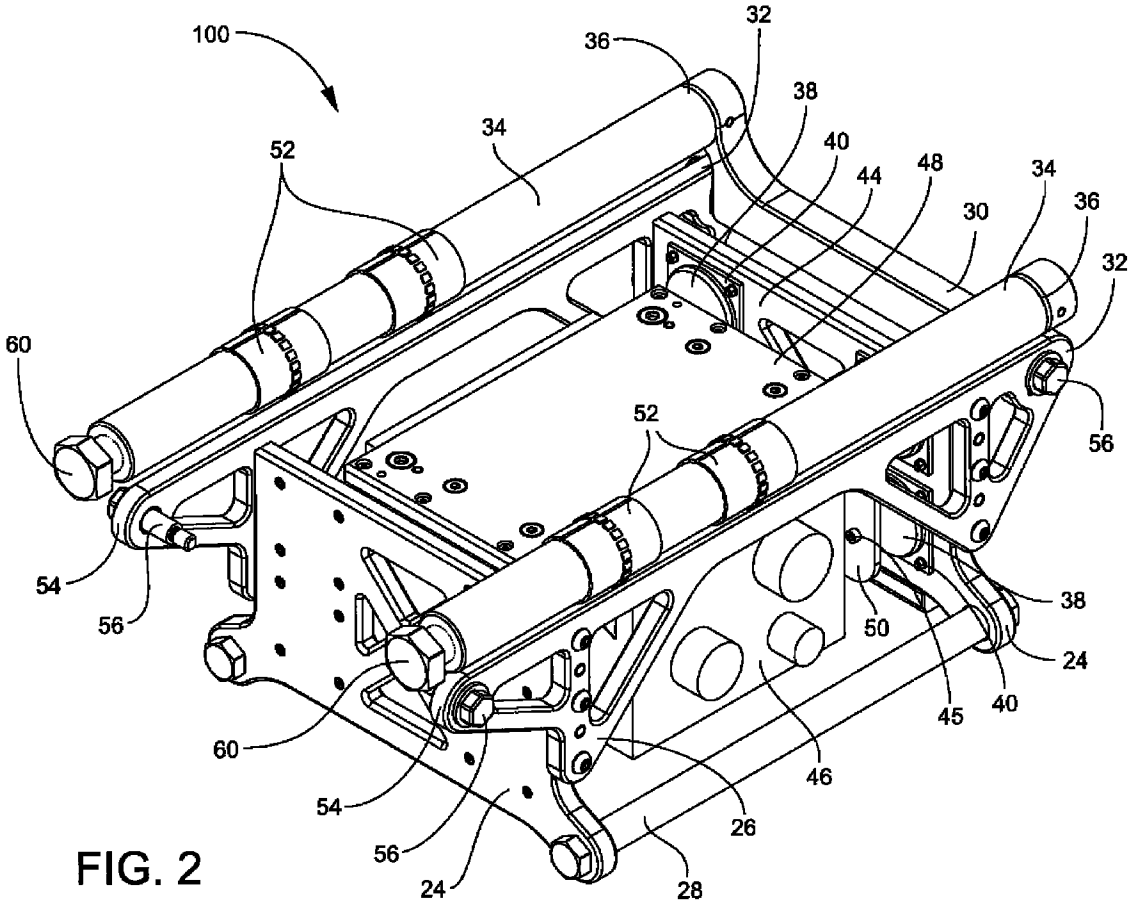
FIG. 2 is a perspective view of an embodiment of an apparatus for mounting an electronics unit to a mortar bipod.

FIG. 2 is a perspective view of an embodiment of an apparatus 100 for mounting an electronics unit, such as DFCS 46 to mortar bipod 10. Apparatus 100 may include a pair of spaced-apart, generally parallel mounting brackets 24 having respective inner faces 44. A pair of support rails 26 may be fixed to opposite outer edges of mounting brackets 24. A pair of support rods 28 may be fixed between opposite lower portions of mounting brackets 24. A lower guide rod housing 30 may be fixed to ends 32 of support rails 26. A pair of fire control guide rods 34 may have ends 36 fixed to lower guide rod housing 30. Bearings 52 may be disposed on each of fire control guide rods 34.

Figure 7:
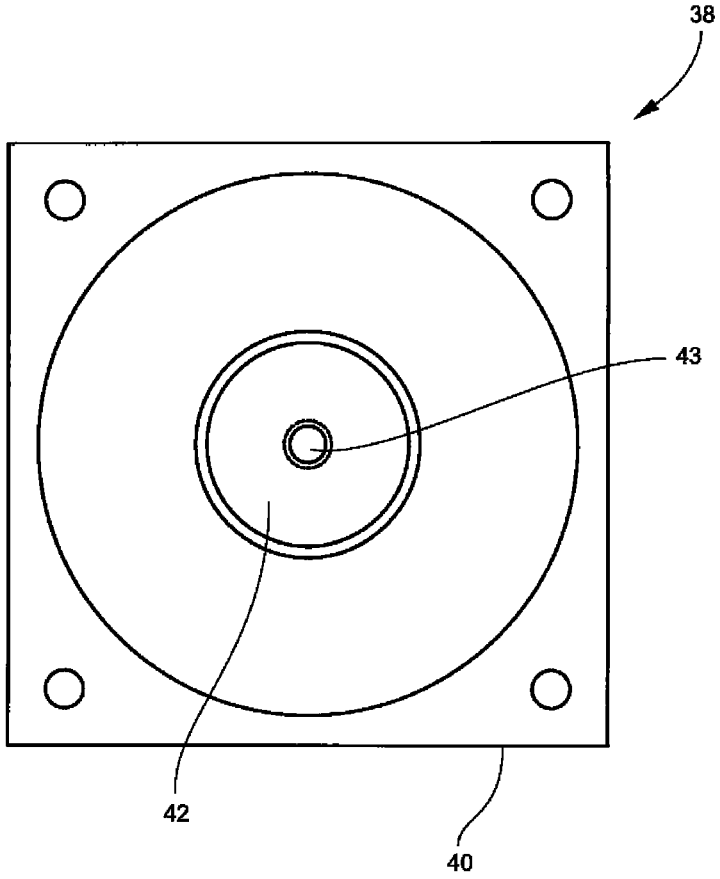
FIG. 7 is a top view of an exemplary shock mount for use in the apparatus of FIG. 2.

A plurality of shock mounts 38 may have respective bases 40 and tops 42 (see FIG. 7 also). Shock mount bases 40 may be rigid and may be fixed to respective inner faces 44 (FIG. 2) of mounting brackets 24. An electronics unit, such as, for example, a DFCS 46 may have a top plate 48 fixed thereto. A pair of side plates 50 may be fixed to top plate 48. Only one side plate 50 is visible in FIG. 2. Side plates 50 may extend generally perpendicularly from top plate 48. Thus, top plate 48 and side plates 50 may form a generally inverted U-shape, as oriented in FIG. 2.

Tops 42 (FIG. 7) of shock mounts 38 may comprise a rigid insert with an opening 43. Top 42 of shock mount 38 may be fixed to side plates 50 by inserting a fastener 45 (FIG. 2) through side plate 50 and opening 43 in top 42 of shock mount 38. In the embodiment shown, eight shock mounts 38 may be used. However, other embodiments of apparatus 100 may include fewer or more shock mounts 38. Shock mounts 38 may provide isolation from shock loads, thereby protecting DFCS 46.

As shown in FIG. 1, traverse yoke 22 may be fixed to ends 54 of support rails 26. Traverse yoke 22 may include a pair of openings 58 (FIG. 3) for receiving fire control guide rods 34. Removable fasteners 56 may be used to fix ends 54 of support rails 26 to traverse yoke 22 and to fix ends 32 of support rails 26 to lower guide rod housing 30. Removable fasteners 60 may be used to fix fire control guide rods 34 to traverse yoke 22.

Figure 4:
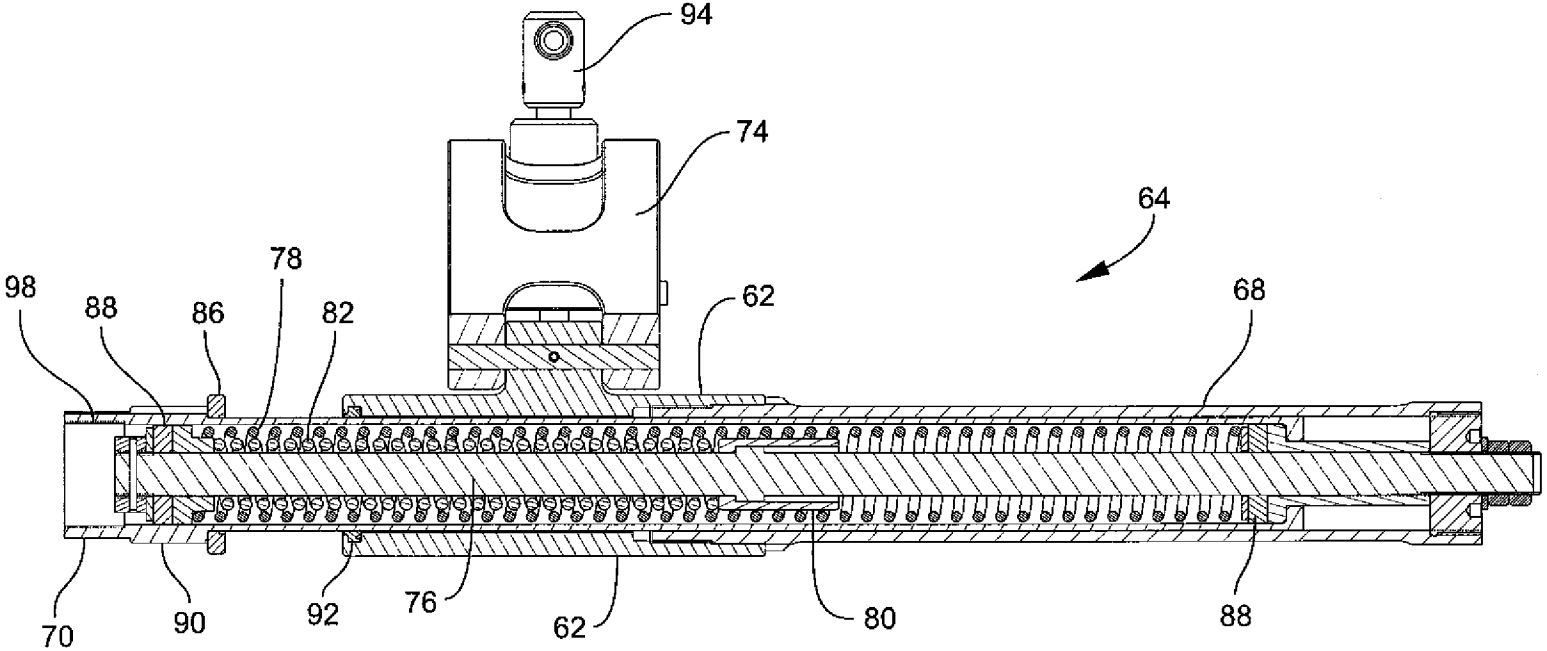
FIG. 4 is a sectional view of one of the buffers of FIG. 1.

Referring to FIG. 1, bipod 10 may include a cannon lower clamp 62 and a pair of bipod buffers 64, 64. Each bipod buffer 64 may include a recoil housing 68 (FIG. 4). Recoil housing 68 may be fixed to cannon lower clamp 62 for translation therewith. Traverse yoke 20 may include a pair of openings 66 (FIG. 3) for receiving ends 70 (FIG. 4) of bipod buffers 64. Ends 70 of bipod buffers 64 may be fixed to traverse yoke 22. Fire control guide rods 34 may be translatably disposed in openings 72 (FIG. 1) in cannon lower clamp 62.

Figure 5:
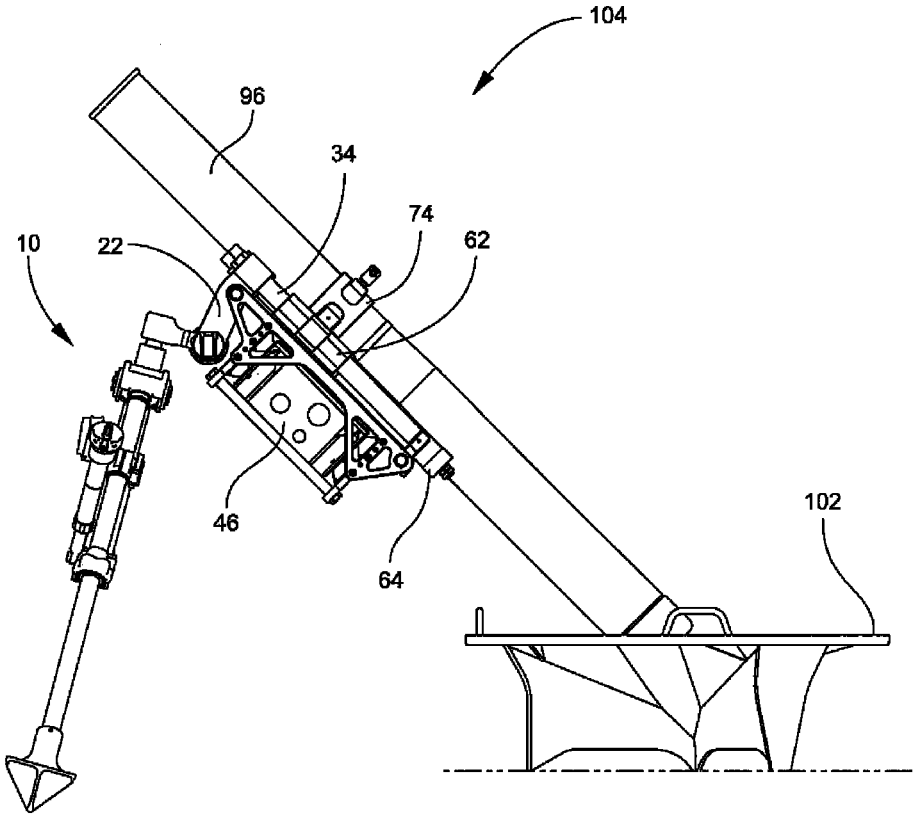
FIG. 5 is a side view of an embodiment of a mortar system including the bipod of FIG. 1, prior to firing.

FIG. 4 is a sectional view of one of the bipod buffers 64 of FIG. 1. Bipod buffers 64 may provide stability to bipod 10 by disconnecting the cannon 96 (FIGS. 5-6) and firing loads from the remainder of bipod 10. Buffers 64 may have a dual spring preloaded design that may reduce backlash or play. A recoil housing 68 may be threaded into lower clamp 62. Cannon lower clamp 62 may be attached to cannon upper clamp 74. During firing, cannon upper clamp 74 may respond to the firing loads by traveling with cannon 96.

Because recoil housing 68 is also attached to cannon lower clamp 62, recoil housing 68 may move with cannon 96 and may pull recoil rod guide 76, thereby compressing primary recoil spring 78. If enough distance is traveled, secondary spring guide 80 will bottom out and engage secondary recoil spring 82. Once the firing loads are fully absorbed by the soil, compressed springs 78, 82 may decompress and return the disconnected portion of bipod 10 to its neutral position. If the spring force of springs 78, 82 is such that the disconnected bipod 10 may be returned to its neutral position at a relatively quick pace (to maintain system stability), the buffers 64 may possibly over travel.

Recoil end caps 84 (FIG. 1) may have externally threaded portions (not shown) that may engage internal threads 98 in ends 70 of buffers 64. The externally threaded portion of end cap 84 may include an opening therein (not shown) that may allow for an over travel condition. The opening in externally threaded portion of end cap 84 may avoid a metal to metal bottoming out. A recoil bump stop 86 may help avoid a metal to metal bottoming out. Bump stop 86 may be made of, for example, silicon rubber.

To minimize metal to metal contact between the moving components of buffer 64, spring guide washers 88 may be used. Spring guide washers 88 may be made of, for example, polyurethane. To minimize the entrance of foreign objects such as dirt into buffer 64, a seal 92 may be used. A clamp handle 94 may be fixed to cannon upper clamp 74.

DFCS 46 may be attached to traverse yoke 22 by inserting fire control guide rods 34 through traverse yoke 22 and then attaching fasteners 56 to the sides of traverse yoke 22. Four bearings 52 (FIG. 2) may be inserted into cannon lower clamp 62 to allow for smooth movement around fire control guide rods 34, thereby creating separation of buffers 64 and DFCS 46.

Figure 6:
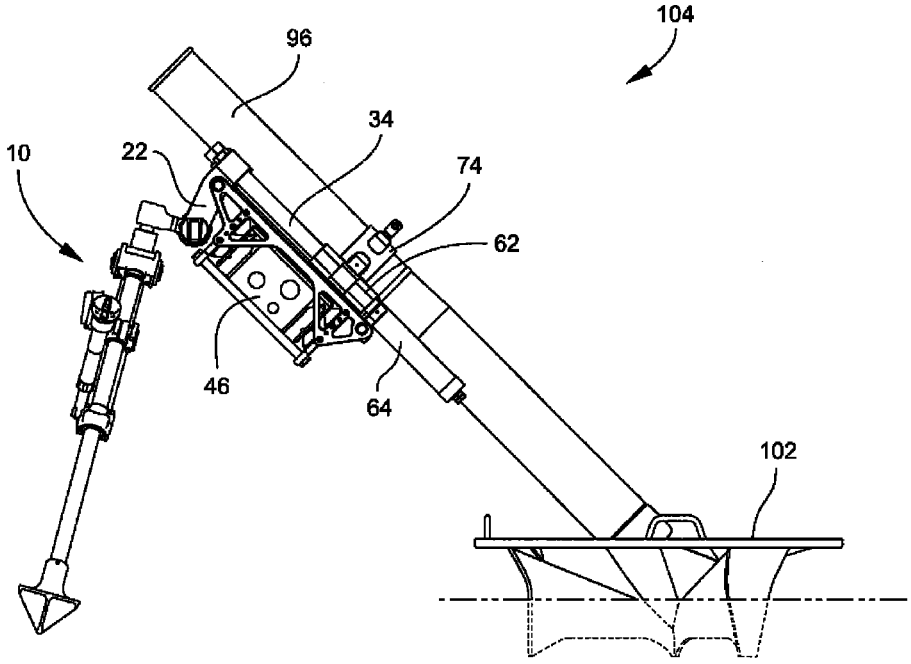
FIG. 6 is a side view of the mortar system of FIG. 5, after firing.

Before firing, bipod buffers 64 may be in a neutral configuration (FIG. 5) for maximum stabilization. During firing, the forces acting against cannon 96 may force both cannon 96 and baseplate 102 into the ground (FIG. 6). Cannon upper and lower clamps 74, 62 may also move with cannon 96, thereby forcing bipod buffer springs 78, 82 (FIG. 4) to compress and disconnect the remainder of bipod 10 from the firing loads. Once movement of cannon 96 and baseplate 102 ceases, buffer springs 78, 82 may return the disconnected portion of bipod 10 back to the buffer neutral position, thus creating a stable platform and preparing the mortar system 104 for the next round.

Apparatus 100 may significantly decrease shock loads to DFCS 46. In the event of a misfire, apparatus 100 may enable one to easily remove DFCS 46, thereby simplifying misfire procedures and providing a safer environment.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for mounting an electronics unit to a mortar bipod, said electronics unit having a top plate thereon and a pair of side plates fixed to said top plate and extending generally perpendicular thereto, said apparatus for mounting comprising:

a pair of spaced-apart, generally parallel mounting brackets having respective inner faces;

a pair of support rails fixed to opposite outer edges of the mounting brackets;

a pair of support rods fixed between opposite lower portions of the mounting brackets;

a lower guide rod housing fixed to first ends of the support rails;

a pair of fire control guide rods having first ends fixed to the lower guide rod housing;

a plurality of shock mounts having respective bases and tops, the shock mount bases being fixed to the respective inner faces of the mounting brackets, and, the tops of the shock mounts being fixed to said side plates.

2. The apparatus of claim 1, further comprising bearings disposed on each of the fire control guide rods.

3. The apparatus of claim 2, wherein the electronics unit is a digital pointing device.

4. The apparatus of claim 2, further comprising a traverse yoke fixed to seconds ends of the pair of support rails, the traverse yoke including a pair of openings for receiving the pair of fire control guide rods.

5. The apparatus of claim 4, further comprising removable fasteners for fixing the second ends of the support rails to the traverse yoke and for fixing the first ends of the support rails to the lower guide rod housing.

6. The apparatus of claim 5, further comprising second removable fasteners for fixing the fire control guide rods to the traverse yoke.

7. A mortar bipod, comprising:

a pair of leg assemblies;

a cross-level mechanism connected to one of the leg assemblies;

an elevation assembly connected to the cross-level mechanism and to a traverse assembly; and the apparatus of claim 4, wherein the traverse assembly includes the traverse yoke.

8. The bipod of claim 7, further comprising a cannon lower clamp and a pair of bipod buffers, each bipod buffer including a recoil housing fixed to the cannon lower clamp for translation therewith, the traverse yoke including a second pair of openings for receiving ends of the bipod buffers, the ends of the bipod buffers being fixed to the traverse yoke.

9. The bipod of claim 8, wherein the pair of fire control guide rods are translatably disposed in openings in the cannon lower clamp.

10. The bipod of claim 9, wherein each bipod buffer includes a recoil spring housing translatably disposed in the recoil housing, a recoil rod guide fixed for translation with the recoil housing, and at least one spring disposed in the recoil spring housing, wherein the at least one spring is compressed by translation of the recoil rod guide.

11. A mortar system, comprising:

the mortar bipod of claim 10;

a cannon upper clamp;

a cannon fixed between the cannon upper clamp and the cannon lower clamp; and a baseplate for receiving an end of the cannon.

12. A method of isolating an electronics unit from firing loads of a cannon, wherein the electronics unit comprises a digital fire control system, said method comprising:

providing a bipod for the cannon; and mounting the electronics unit on a portion of the bipod that is not fixed for movement with the cannon and, wherein the bipod includes an apparatus for mounting the digital fire control system to the bipod, the apparatus comprising:

a pair of spaced-apart, generally parallel mounting brackets having respective inner faces;

a pair of support rails fixed to opposite outer edges of the mounting brackets;

a pair of support rods fixed between opposite lower portions of the mounting brackets;

a lower guide rod housing fixed to first ends of the support rails;

a pair of fire control guide rods having first ends fixed to the lower guide rod housing;

a plurality of shock mounts having respective bases and tops, the shock mount bases being fixed to the respective inner faces of the mounting brackets;

the digital fire control system having a top plate fixed thereto; and a pair of side plates fixed to the top plate and extending generally perpendicular thereto, and whereby the tops of the shock mounts are fixed to the side plates.

* * * * *